United States Patent [19]

Ecker et al.

[11] 3,988,177

[45] Oct. 26, 1976

[54] METHOD OF PRODUCING COLD ROLLED, SILICON-ALLOYED ELECTRIC SHEETS

[75] Inventors: Karl Ecker, Leonding; Ingeborg Richter; Max Mayrhofer, both of Linz, all of Austria

[73] Assignee: Vereinigte Osterreichische Eisen- und Stahlwerke-Alpine Montan Aktiengesellschaft, Linz, Austria

[22] Filed: Oct. 21, 1974

[21] Appl. No.: 516,142

[30] Foreign Application Priority Data

Nov. 5, 1973 Austria ..... 9270/73

[52] U.S. Cl. ..... 148/111; 148/31.55; 148/112

[51] Int. Cl.[2] ..... H01F 1/04

[58] Field of Search ..... 148/110, 111, 112, 113, 148/31.55, 12, 120, 121

[56] References Cited

UNITED STATES PATENTS

| | | | |
|---|---|---|---|
| 2,307,391 | 1/1943 | Cole et al. | 148/12 |
| 3,165,428 | 1/1965 | Albert et al. | 148/111 |
| 3,347,718 | 10/1967 | Carpenter et al. | 148/111 |
| 3,522,114 | 7/1970 | Knuppel et al. | 148/111 |
| 3,575,739 | 4/1971 | Fiedler | 148/111 |
| 3,671,337 | 6/1972 | Kumai et al. | 148/111 |
| 3,764,406 | 10/1973 | Littmann | 148/111 |
| 3,770,517 | 11/1973 | Gray et al. | 148/111 |
| 3,867,211 | 2/1975 | Easton | 148/31.55 |

*Primary Examiner*—Walter R. Satterfield
*Attorney, Agent, or Firm*—Brumbaugh, Graves, Donohue & Raymond

[57] ABSTRACT

A method of producing cold rolled, silicon-alloyed electric sheets from a vacuum decarburized steel involves decarburizing and recrystallizing annealing of the sheets in a continuous furnace. The recrystallization behavior of the sheets is influenced in such a way that a coarse grain and low watt losses are achieved. In the vacuum decarburized melt a manganese content, lying between 0.25 and 0.80% by weight, is adjusted. The slab temperature prior to hot rolling is kept below a particular temperature that depends on the manganese content according to the equation $$t = \frac{-14\,480}{\log \mathrm{Mn} - 9.20} - 273.$$

Hot rolling of the sheets is effected at a final rolling temperature lying above 840° C and the decarburizing and recrystallizing annealing of the cold rolled sheet is carried out over a period of not more than 4 minutes, whereby the carbon content is reduced to less than 0.003% by weight.

4 Claims, 1 Drawing Figure

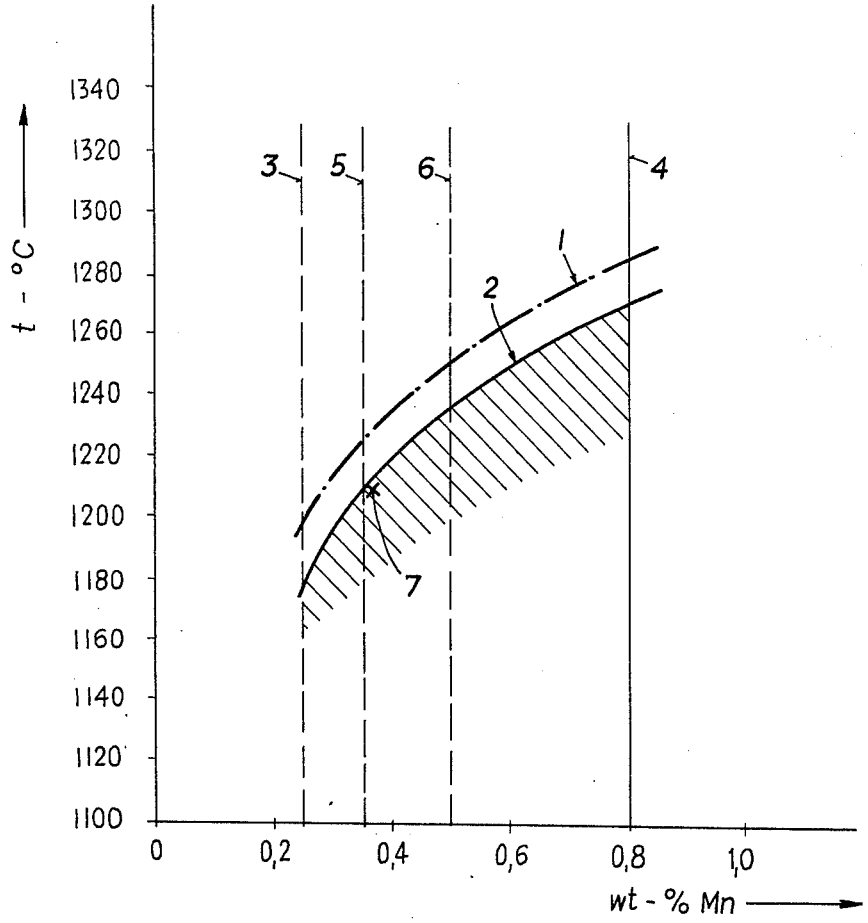
1340
1320
1300
1280
1260
1240
1220
1200
1180
1160
1140
1120
1100
t - °C
0
0,2
0,4
0,6
0,8
1,0
wt - % Mn
1
2
3
4
5
6
7

METHOD OF PRODUCING COLD ROLLED, SILICON-ALLOYED ELECTRIC SHEETS

BACKGROUND OF THE INVENTION

The invention relates to a method of producing cold rolled, silicon-alloyed electric sheets, having a watt loss or iron loss at 10,000 gauss and 50 Hz, $V_{10/50}$, of less than 2.3 watt/kp (watts per kilopound), from an unkilled mild steel melt containing 0.03 to 0.06% by weight of C. The melt is vacuum decarburized to reduce its carbon content to less than 0.02% by weight. First aluminum and subsequently silicon are added to the melt for deoxidation, whereupon the melt is cast to form slabs. The slabs are hot rolled and then cold rolled. A decarburizing and recrystallizing annealing is finally carried out in a continuous furnace for the purpose of further reducing the carbon content to less than 0.005% by weight.

It is known to start the production of electric sheets from a steel having a low content of impurities; i.e. the contents of C, Mn, S, P, Cr and Cu should be as low as possible because the watt loss or the coercive force is increased by disturbed spots of critical size, e.g. by fine oxides or by stress fields of displacements. Furthermore, it is desirable to achieve a structure in the steel as coarse-grained as possible, since this has a favorable influence on the magnetic properties.

Normally the carbon content is reduced to less than 0.005%, on the one hand, by vacuum treatment of a steel which in its original state is unkilled and, on the other hand, by decarburizing annealing of the cold rolled sheets or strips in a continuous furnace in which the recrystallization of the structure also occurs. This process is described e.g. in the German Auslegeschrift No. 1,458,852 and in the Austrian Patent Specification No. 307,469. It is desirable to keep the annealing periods in the continuous furnace as low as possible, i.e. to run the strips through the furnace at the highest possible velocities consequently, it is necessary to get the carbon content of the liquid melt to low values.

In the customary technology it has turned out that in the vacuum treatment of the molten, unkilled steel not only does a decarburization occur, but also there is a considerable reduction of the Mn-content as a consequence of the higher vapor pressure of the Mn. In steels containing less than 0.15% by weight of Mn, which content is in general considered the upper permissible limit for good qualities of electric sheets, and a carbon content of less than 0.020% by weight, in particular less than 0.010% by weight, at the end of the decarburizing vacuum treatment an unfavorable recrystallization behavior of the cold rolled sheets produced from such steels has been found. The grain was relatively fine and unduly high watt losses were measured. Attempts to increase the Mn-content brought about only minor improvements.

SUMMARY OF THE INVENTION

It is the object of the invention to provide a process of producing cold rolled electric sheets from vacuum decarburized steel that has been subjected to a decarburizing and recrystallizing annealing in a continuous furnace by influencing the recrystallization behavior of the sheets in such a way that coarse grain and low watt losses result. Moreover, the period in which the strip passes through the continuous furnace is to be kept at a minimum so as to ensure an economical operation of the continuous furnace.

According to the invention in a process of the above described type this task is solved by the steps of (1) setting a manganese content of 0.25 to 0.80% by weight, preferably of 0.35 to 0.50% by weight, in the vacuum decarburized melt; (2) keeping the slab temperature $t$ before hot rolling — said temperature being measured in °C prior to drawing the slab from a continuous furnace — in dependence upon the manganese content in % by weight at a value lying below the limit temperature given by the equation $$t = \frac{-14\,480}{\log \mathrm{Mn} - 9.20} - 273;$$

(3) carrying out the hot rolling procedure while maintaining a final rolling temperature lying above 840° ; and (4) carrying out the decarburizing and recrystallizing annealing of the cold rolled strip or sheet over a period of not more than 4 minutes, wherein the carbon content is reduced to less than 0.003% by weight.

The essence of the invention therefore consists in combining a manganese content, which is to be set relatively high compared to normal experience, with temperatures in the continuous furnace and during the hot rolling that depend on the manganese content. The temperature at the end of hot rolling is to be as high as possible and the temperature during drawing of the slab from the continuous furnace, i.e. at the beginning of the rolling procedure, is to be as low as possible. On account of the high manganese content coordinated with the temperature, low watt losses are achieved. The upward limitation of the slab temperature according to the invention prevents the dissolving of sulfur and oxygen in the case of extremely low carbon contents which dissolved materials occur in the form of sulfides and oxides. Should this be the case, the finest precipitations of these sulfides and oxides would impede the recrystallization procedure. According to the invention the higher manganese contents in the steel and the higher temperatures of the rolled piece according to the above equation permit the dissolution of the sulfides and/or oxides without undue effect.

A preferred embodiment of thle process of the invention has the slab temperature t at a value lying below a temperature defined by the equation $$t = \frac{-14\,480}{\log \mathrm{Mn} - 9.30} - 273$$

and the hot rolling carried out while maintaining a final rolling temperature lying above 860° C.

A further feature of the invention requires that the decarburizing and recrystallizing annealing of the strip or sheet lasts not more than 3 minutes.

BRIEF DESCRIPTION OF THE DRAWING

The correlation according to the invention between the temperature of the rolled piece and the Mn-content is illustrated in the graph of the FIGURE.

DESCRIPTION OF A PREFERRED EMBODIMENT

There is plotted on the abscissa of the graph of the FIGURE the Mn-content of the steel in per cent by weight and on the ordinate of the graph is the rolled piece temperature $t$ in °C measured prior to drawing the slab from th continuous furnace, i.e. practically at the beginning of wide strip rolling. The dash-and-dot line 1 indicates an upper limit curve corresponding to the equation $$t = \frac{-14\,480}{\log \mathrm{Mn} - 9.20} - 273$$

and reference number 2 denotes a full line curve corresponding to the equation $$t = \frac{-14\,480}{\log \mathrm{Mn} - 9.30} - 273.$$

Preferably the rolled piece temperatures measured in the continuous furnace are to lie below curve 2 in the field indicated by hatched lines. The vertical lines 3 and 4 indicate the range of the Mn-content to which the invention is applicable, and the broken lines 5 and 6 indicate the preferred Mn-content within the range between 0.35 and 0.50% by weight. Reference number 7 denotes an individual value referring to the following embodiment.

In a converter for 30 metric tons an unkilled steel having the following chemical composition 0.051% by weight C,
0.28 % by weight Mn,
0.012% by weight S, and
455 ppm oxygen was produced according to the oxygen blowing process and was then subjected to a decarburizing vacuum treatment using a degassing apparatus that involves an alternate lifting and lowering of the vacuum vessel. Between the 18th and the 22nd stroke 130 kp of aluminum granules were added, between the 23rd and the 33rd stroke 870 kp of ferrosilicon were added and at the 24th stroke 28 kp of Mn-affine were added. After a total of 40 degassing strokes the following casting analysis was found:

0.009% by weight C,
1.78 % by weight Si,
0.37 % by weight Mn,
0.018% by weight P,
0.011% by weight S, and
0.346% by weight Al.

The ingots of this vacuum decarburized steel cast to form slab ingots were heated in a pit furnace up to a rolling temperature of 1220° C. The slab ingots were then rolled on a slab rolling train and the pre-rolled slabs were heated in a continuous furnace up to 1210° C (point 7 in the graph) and subsequently drawn. After rolling in five passes on a pre-rolling stand an outgoing temperature of 1050° C was measured. Further rolling was effected on a semi-continuous six-stand wide strip rolling train, wherein a 2.0 mm thick hot rolled strip was produced while maintaining a final rolling temperature of 885° C or a reel temperature of 740° C. The hot rolled strip was cold rolled in three passes to 0.5 mm and was subjected to a recrystallizing and decarburizing annealing in a conventional continuous furnace while it traveled at a velocity of 26 m per minute and was maintained at a temperature of 910° C. This corresponds to an annealing time (holding time) at this temperature of approximately 2.8 minutes. According to ASTM the grain size lay between 4 and 5 after recrystallization. The mixed Epstein sample gave a magnetic reversal loss $V_{10/50}$ (at 10 000 gauss and 50 Hertz according to DIN 46.400) of 2.05 watt/kp.

The method of the invention is not limited to ingot casting only — as described in the above embodiment — but it may also be used for continuously cast slabs.

It has been found that the favorable effect of the Mn-content in combination with the other production conditions is independent of the P and Al contents which lie at usual limits within 0.005 and 0.20% by weight of P and 0.0 to 0.50% by weight of Al.

What we claim is:

1. In a method of producing a cold rolled, non-oriented grain, silicon-alloyed electrical steel sheet with a watt loss, $V_{10/50}$, of less than 2.3 watt/kp from an unkilled mild steel melt having a carbon content of 0.03 to 0.06% by weight, which melt has its carbon content reduced to less than 0.02% by weight by vacuum decarburization and to which melt for deoxidation first aluminum and subsequently silicon are added, whereupon the melt is cast to form a slab, said slab being heated in a continuous furnace to a certain temperature and then hot rolled and subsequently cold rolled to form a strip or sheet that has its carbon content further reduced to less than 0.005% by weight by decarburizing and recrystallizing annealing the sheet in a continuous furnace, wherein the improvement comprises the steps of:

setting a manganese content of 0.25 to 0.80% by weight in the vacuum decarburized melt, maintaining the slab temperature $t$, measured in °C prior to drawing the slab from the continuous furnace and before hot rolling, in dependence upon the manganese content in percent by weight at a value lying below a limit temperature given by the equation $$t = \frac{-14{,}480}{\log \mathrm{Mn} - 9.20} - 273,$$

carrying out hot rolling while maintaining a final rolling temperature lying above 840° C, and carrying out the decarburizing and recrystallizing annealing of the cold rolled strip or sheet over a period of not more than 4 minutes, wherein the carbon content is reduced to less than 0.003% by weight.

2. The method set forth in claim 1, wherein a manganese content of 0.35 to 0.50% by weight is set in the vacuum decarburized melt.

3. The method set forth in claim 1, wherein the slab temperature $t$ is kept at a value lying below a temperature given by the equation $$t = \frac{-14\,480}{\log \mathrm{Mn} - 9.30} - 273$$

and wherein hot rolling is carried out while maintaining a final rolling temperature lying above 860° C.

4. The method set forth in claim 1, wherein the decarburizing and recrystallizing annealing of the strip or sheet lasts maximumly 3 minutes.

* * * * *